United States Patent [19]

Fellows

[11] 3,957,103

[45] May 18, 1976

[54] MOLD MAKING METHOD AND APPARATUS

[76] Inventor: Harrison E. Fellows, Clearwater Lake, Wis. 54518

[22] Filed: Nov. 15, 1974

[21] Appl. No.: 524,164

[52] U.S. Cl. ..... 164/16; 164/40; 164/159

[51] Int. Cl.[2] ..... B22C 9/12

[58] Field of Search ..... 164/16, 37, 40, 12, 164/159

[56] References Cited

UNITED STATES PATENTS

| | | | |
|---|---|---|---|
| 3,059,294 | 10/1962 | Dunn et al. | 164/16 X |
| 3,730,250 | 5/1973 | Fellows | 164/37 X |

*Primary Examiner*—Francis S. Husar
*Assistant Examiner*—Carl Rowold
*Attorney, Agent, or Firm*—Wheeler, Morsell, House & Fuller

[57] ABSTRACT

Automatic molding apparatus to make flaskless molds from match plate patterns using sand and binder pre-mix and an activator or catalyst includes form boxes having open faces and double wall construction with a continuous chamber between the walls. The inner wall is vented to the chamber to provide a gas flow passage. The apparatus also includes manifolds which clamp over openings in the top and bottom walls for innoculation and pneumatic withdrawal of activating or catalytic-reacting gases such as hot air or carbon dioxide which are innoculated at an innoculation station into the mold box to decrease the hardening time of the sand. The open faces of the mold box are closed by hinge plates or cover plates each rotated by a rack and pinion. The plates are further secured during sand filling by spring-loaded arms bearing against tapered ribs on the hinge plates. The apparatus also includes improved sand filling apparatus with a chute which travels on tracks from a retracted position to a filling position beneath an overhead hopper containing the sand-binder pre-mix. The chute is provided with flanges which ride on trolley wheels having fixed axes. The magazine which receives the sand is provided with a hinged cover which is opened and closed with a power cylinder and sealed with a cam lock.

5 Claims, 6 Drawing Figures

MOLD MAKING METHOD AND APPARATUS

BACKGROUND OF INVENTION

The present invention is a further development of the subject matter shown in my previous U.S. Pat. Nos. 3,589,431 and 3,730,250. These patents disclose a turntable to rotate the mold boxes between various stations during the preparation procedure. These patents show five stations, with station one for cleaning the mold boxes of sand and pattern placement; station two, a sand filling station; station three, pattern removal; station four, core insertion; and station five, mold ejection. In the present invention a new station three is added between existing stations two and three and in which hot air or catalytic or activator gas is added to react with the binder in the sand pre-mix to decrease the hardening time.

Various sand pre-mixes have in recent years become available which contain a variety of binders, catalysts, and activators which have rapid curing times and produce molds of greater dimensional accuracy, compression strength and stability so that high quality castings can be prepared. The present invention provides a method and apparatus for utilizing these mixes in an automated sequence and improved apparatus for transfer of sand to the form boxes.

SUMMARY OF INVENTION

A mold box is disclosed which has open faces and a double wall construction which forms a continuous perimeter to define the sand cavity. The mold or form boxes are provided with a series of vents from the inside wall to the outside wall with a gas discharge opening or suction connection connectable to assist moving the hot air or catalyst or activator through the sand, through the inside wall openings, through the chamber between the double walls, and exteriorly of the mold box. At the innoculation station, subsequent to the sand filling operation, and where the gas is added, upper and lower manifolds are clamped against upper and lower openings in the form boxes for injection and withdrawal of the gas.

The invention also provides a new apparatus for delivering sand to the magazine which includes a hinged cover on the magazine which is movable from a closed to an open position using a hydraulic cylinder and a chute which is movable from a remote position to enable closing the magazine to a position over the magazine and below the hopper to measure a predetermined quantitiy of sand for delivery to the magazine where the sand is delivered under pressure into the sand fill opening in the mold boxes.

At the sand filling station, the cover plates on the assembled mold boxes are further secured to the faces of the mold box by tapered ribs on the mold box side plates which are pressure cammed against the edges of the mold boxes by spring-loaded bell cranks on the sand shoot head which engage the ribs and the cover plates. Alternatively, the cranks or levers can be operated by pistons and hydraulic pressure locked behind the pistons.

Further objects and advantages of the invention will become apparent from the following disclosure.

DETAILED DESCRIPTION OF PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
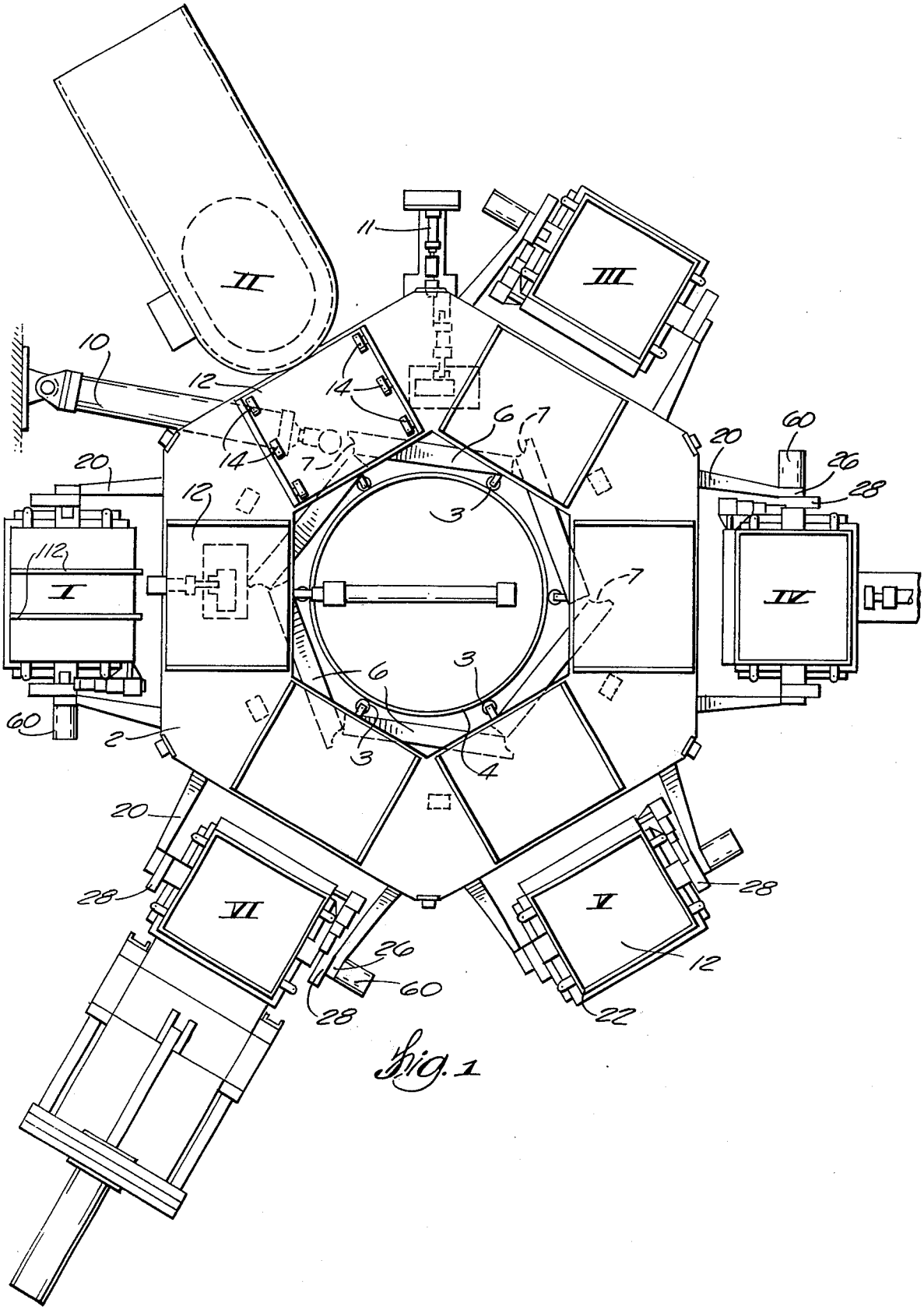
FIG. 1 is a diagrammatic plan view of parts of mold making apparatus in accordance with the invention with overhead structure removed to expose certain apparatus.

FIG. 1 shows six working stations, although more or less can be employed. Station one is a cleaning station for cleaning the sand out of the mold boxes to initiate the sequence and to introduce the pattern between the mold boxes; station two is the sand filling station; station three is the gas innoculation station, which is not included in the disclosure of my previous U.S. Pat. No. 3,589,431; station four is a pattern removal station; station five is a core setting station; and at station six the molds are removed and sent to the mold pouring station.

The apparatus is provided with an annular turntable 2 which has rollers 3 which guide the turntable for rotation about a post 4. The turntable is supported by rollers 5 rotated beneath the turntable 2. The turntable carries an annular indexing plate 6 provided with indexing shoulders 7 engageable with an indexing ram 10. A shot-bolt assembly 11 powered by a hydraulic cylinder is employed to secure the turntable in each of the indexed positions.

The turntable 2 is provided with pattern plate racks 12 for each station with rollers 14 for pattern plates 16 to roll between an advanced position for use and a storage position. In the retracted position each pattern plate 16 is on the turntable 2.

At Station I the form boxes 22, 24 are closed upon the pattern plate 16 and oriented from a horizontal to vertical position as shown in FIGS. 10, 11 or 12 of my U.S. Pat. No. 3,589,431. The assembled form boxes then are indexed to station II for the sand filling step. The manipulation of the form boxes between horizontal and vertical positions and the apparatus employed for that purpose is not described herein in detail because it forms no part of the invention. It is described in my U.S. Pat. No. 3,589,431 and illustrated in FIG. 8 of that patent.

At the sand filling station II, a conventional continuous mixer such as that manufactured by Baker-Perkins or Fordath delivers a pre-mix of sand having a binder with or without catalyst added (the mixer is not shown).

Figures 2, 6:
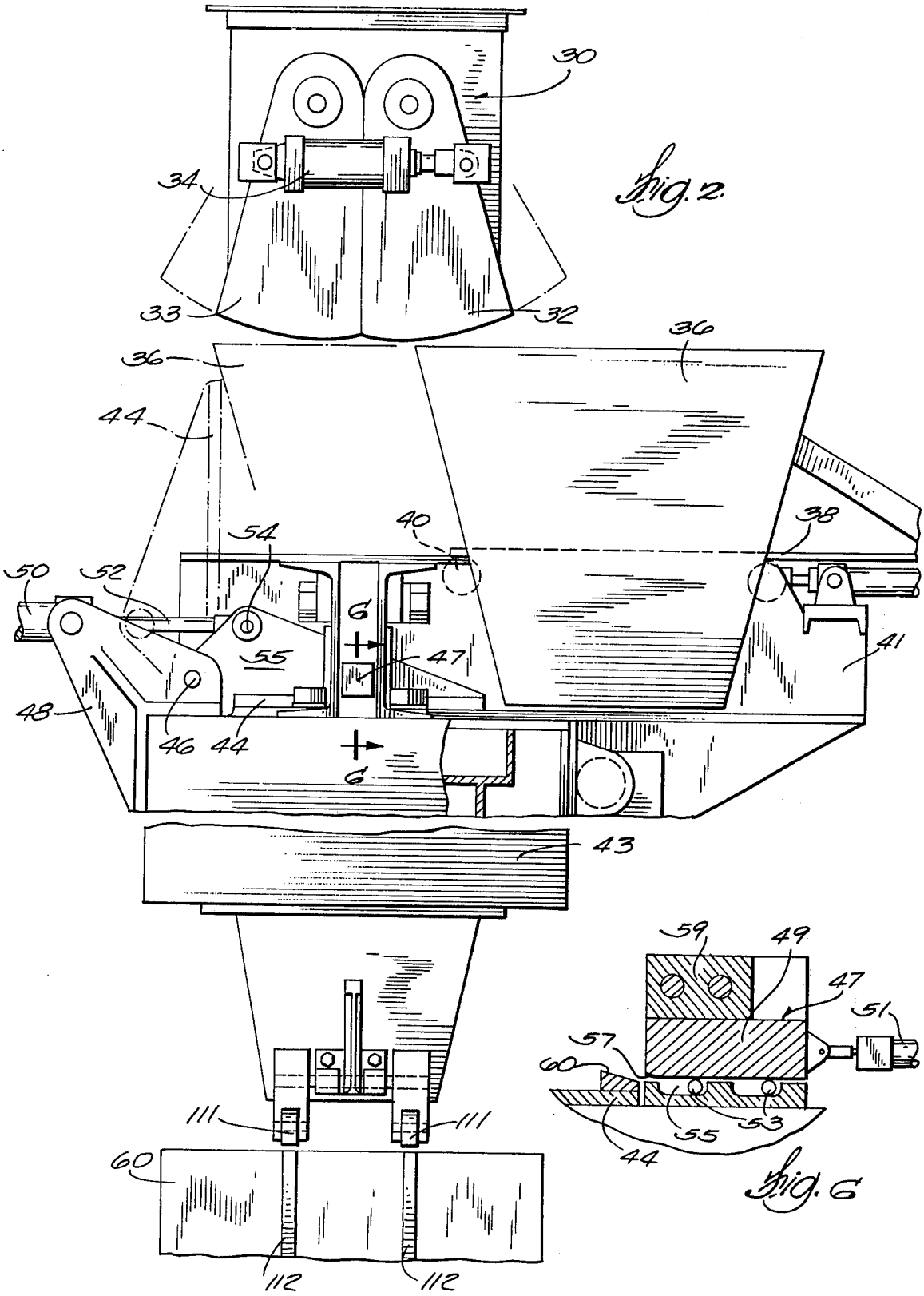
FIG. 2 is an enlarged side elevational view of the sand filling station showing the sand hopper and chute of the invention and their positions relative to the sand magazine.
FIG. 6 is an enlarged fragmentary sectional view of a cam lock for the sand magazine shown in FIG. 2.

Referring to FIG. 2, the mixer delivers sand into a hopper 30 having a pair of pivoted chute doors 32 and 33 which are open and closed by a hydraulic cylinder 34. Sand from the hopper 30 is delivered into a chute 36 which has guide flanges 38 supported on trolley wheels 40 fixed to side rails 41 on each side of the chute. The chute is movable from the position shown in FIG. 2 in full lines to the position shown by dotted lines directly over a magazine 43. Use of the trolley wheels and chute arrangement minimizes difficulty caused by the presence of sand on the sealing surfaces in prior art sand delivery apparatus. The magazine 43 is provided with a magazine cover 44 which is pivoted at 46 to a bracket 48 connected to the magazine. The power cylinder 50 has a piston rod 52 pivotally connected at 54 to a rib 55 on the magazine cover 44. The magazine cover is movable from the full line position shown in FIG. 2 to the dotted line position for entry of sand into the magazine. The cover 44 is tightly sealed by a cam lock mechanism 47 in FIG. 6 and FIG. 2. Two locks 47 are preferably used on each side of the cover 44. The locks 47 include a slide 49 each connected to a power cylinder 51 and guided by roller bearings 53 captured in recesses 55 and guide member 59. A beveled or cam surface 57 engages a ramp 60 on the cover 44 to exert downward pressure on the cover 44.

Figure 5:
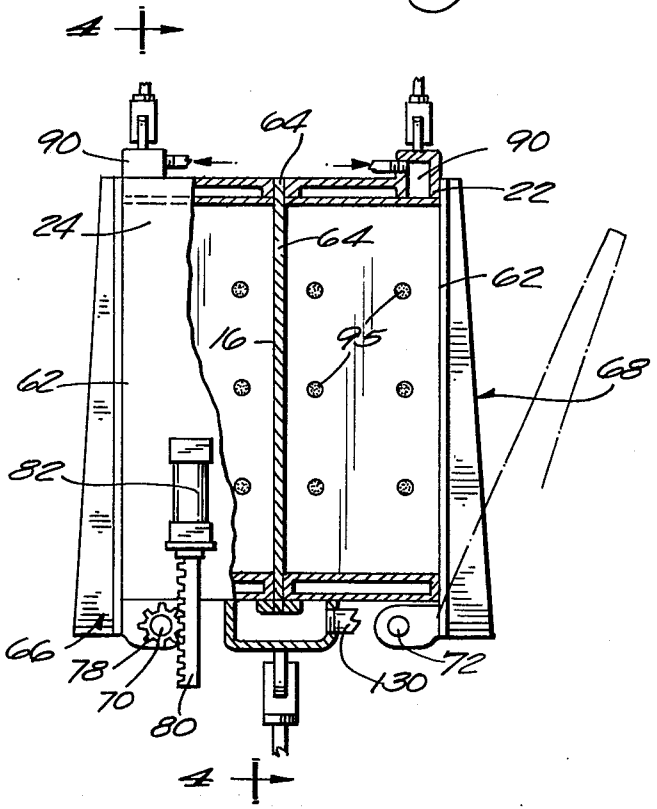
FIG. 5 is an end view of the apparatus shown in FIG. 4.

Referring to FIG. 5, the mold or form boxes 22, 24 are provided with opposed open faces 62 and 64. Faces 64 seal against the pattern plate 16. Faces 62 are closed by hinge or cover plates 66 and 68, which are pivotally mounted on shafts 70 and 72 which are rotatably supported in bearings 74 on the bottom 76 of the form boxes. Shafts 70, 72 are provided with pinion gears 78 which are fixed to the shafts and which mesh with racks 80 operated by power cylinders 82 which are employed to open and close the plates 66 and 68.

Figure 4:
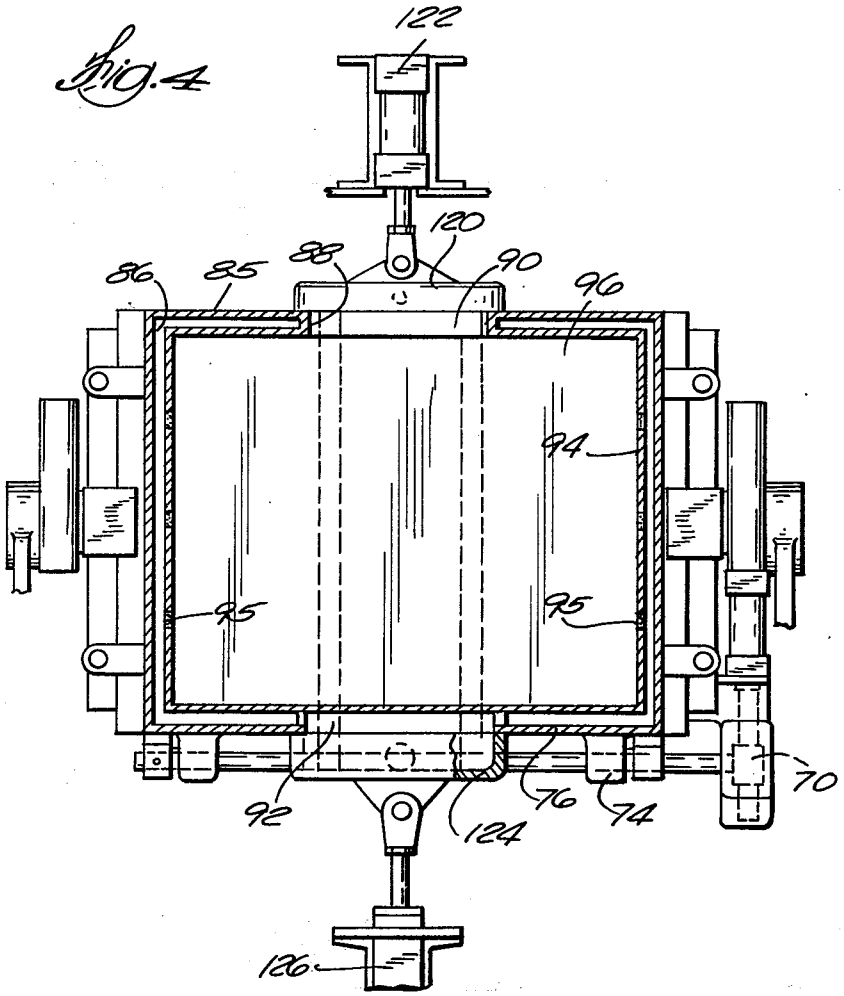
FIG. 4 is a fragmentary view of the innoculation station showing the mold box of the invention in fragmentary section.

As best shown in FIG. 4, the mold boxes 22, 24 are of double wall construction, with an outer wall 85, and an inwardly-spaced inner wall 94. Walls 85 and 94 are spaced by a chamber and gas passage 86. The top wall 88 of each box 22, 24 is provided with a sand filling and gas inlet opening 90, and the lower wall 76 is provided with a gas outlet or exhaust opening 92 which communicates only with the passage 86. A plurality of spaced openings 95 provide communication from the mold box interior 96 with the chamber 86 for purposes subsequently described.

Figure 3:
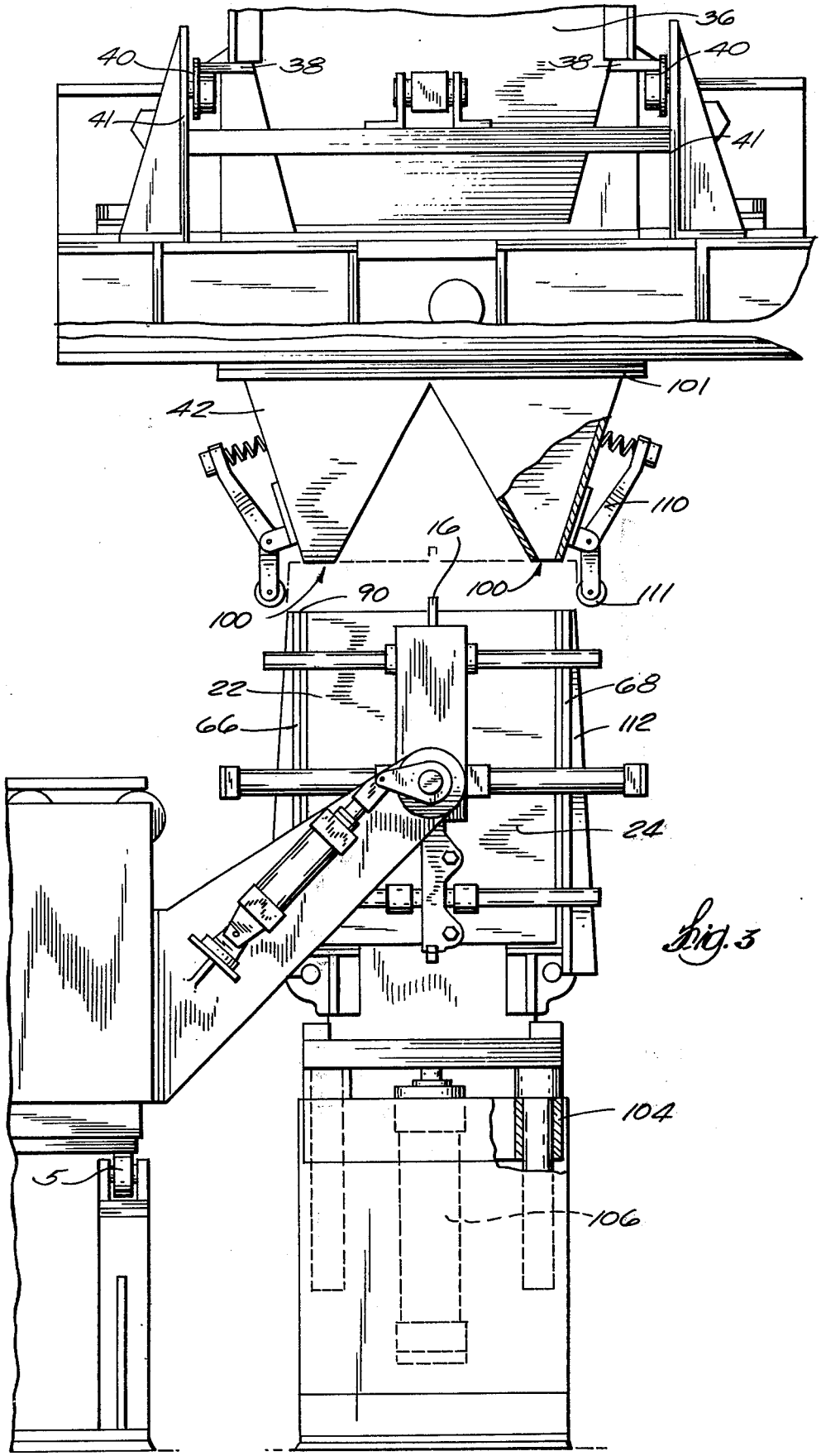
FIG. 3 is a side elevational view of a side different from that shown in FIG. 2 of the sand magazine and mold box.

Referring now to FIG. 3, at the sand filling station II the mold boxes 22, 24 are raised in assembly into contact with the nozzles 100 on the shoot head 101 of magazine 42 by a lift assembly 104 operated by a power cylinder 106. To firmly secure the side plates 66 and 68 to the mold boxes 22, 24, the magazine nozzles are provided with spring-biased bell cranks 110 with rollers 111 which engage tapered ribs 112 on the mold box cover plates 66 and 68 to cam the cover plates 66 and 68 into firm engagement with the mold boxes to provide a good air seal during the pressurized sand filling operation. When the mold box openings 90 are in registry with the nozzles 100, the sand is injected under pressure. The filled mold boxes 22, 24 are then indexed in the same vertical position as they are in at station II to the gas innoculation station III where an upper manifold 120 is clamped against the openings 90 by a power cylinder 122. The exhaust manifold 124 is clamped against the exhaust opening 92 by a power cylinder 126. When the manifolds 120, 124 are in position, gas can then be injected or innoculated into the mold boxes 22, 24, which gas will be distributed randomly through the mold boxes and exhausted through the openings 95 into the chamber 86 and ultimately out an exhaust discharge pipe 130 connected to the manifold 124, either to the atmosphere or a receptacle. Various types of gases are employed, including hot air, to expedite the hardening process. Carbon dioxide and some noxious gases are also utilized for various forms of pre-mix sand. Suction connected to the outlet 130 greatly facilitates flow of the activating gas through the sand mold. The gas can be discharged into the room or, if a noxious gas, can be collected for remote disposal by a collector or receptacle connected to pipe 130.

Stations IV, V and VI are conventional stations disclosed in my previous U.S. Pat. No. 3,589,431. Additional work stations can be employed, depending upon the circumstances.

The sand filling station can also be provided with a spillage conveyor which can be used for receiving the sand pre-mix and avoid hardening in the mixer if the turntable is shut down because of mechanical problems.

What is claimed is:

1. A method of making a sand mold which comprises the steps of providing a form box assembly having wall means defining in part a cavity with open faces for insertion of pattern plates and said wall means including interior and exterior wall portions spaced to provide a gas passage therebetween, apertures in said interior wall portions to afford fluid communication between said cavity and said passage, said wall means further defining a gas inlet to said cavity and a gas outlet in communication with said passage, and closure means to open and close said faces, moving the form box to a sand filling station, filling the form box with sand having a gas activated binder, rotating the form box to a gas innoculation station, injecting gas into the sand to activate the binder and cause hardening of the sand, rotating the form box to a pattern removal station, and moving the form box to a pouring station.

2. The method of claim 1 including the step of collecting the gas after the gas moves through the form box.

3. The method of claim 2 wherein the gas is removed from the form box by suction.

4. The method of claim 1 wherein the form box has open faces and including the preliminary step of closing the faces prior to filling the form box with sand.

5. The method of claim 1 wherein the gas inlet is at the top of the form box and the gas outlet is at the bottom and the gas is introduced into the inlet.

* * * * *